US008009060B2

(12) United States Patent
Kramer et al.

(10) Patent No.: US 8,009,060 B2
(45) Date of Patent: Aug. 30, 2011

(54) REMOTE MONITORING OF MUNITION ASSETS

(75) Inventors: Leslie Kramer, Orlando, FL (US); Keith Fosen, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 1728 days.

(21) Appl. No.: 09/962,671

(22) Filed: Sep. 26, 2001

(65) Prior Publication Data

US 2003/0058130 A1 Mar. 27, 2003

(51) Int. Cl.
*G08B 21/00* (2006.01)

(52) U.S. Cl. ..... 340/870.28; 340/870.16; 340/870.17

(58) Field of Classification Search ..... 340/870.16, 340/870.17, 584, 638.18, 632; 374/5; 702/23; 73/23.31, 23.2; 705/500; 89/1.14, 1.801, 89/1.804, 1.52, 1.55, 1.13; 102/304, 282
See application file for complete search history.

(56) References Cited

U.S. PATENT DOCUMENTS

| | | | | |
|---|---|---|---|---|
| 4,166,244 | A | | 8/1979 | Woods et al. |
| 4,876,530 | A | | 10/1989 | Hill et al. |
| 4,983,352 | A | | 1/1991 | Efferding |
| 5,036,465 | A | | 7/1991 | Ackerman, Jr. et al. |
| 5,053,978 | A | | 10/1991 | Solomon |
| 5,293,771 | A | | 3/1994 | Ridenour |
| 5,301,538 | A | | 4/1994 | Recla |
| 5,528,228 | A | * | 6/1996 | Wilk ..... 340/540 |
| 5,675,506 | A | | 10/1997 | Savic |
| 5,726,637 | A | | 3/1998 | Miyahara et al. |
| 5,786,768 | A | | 7/1998 | Chan et al. |
| 5,854,994 | A | | 12/1998 | Canada et al. |
| 5,862,195 | A | | 1/1999 | Peterson, II |
| 5,877,696 | A | * | 3/1999 | Powell ..... 340/5.33 |
| 5,899,855 | A | * | 5/1999 | Brown ..... 600/301 |
| 5,908,980 | A | | 6/1999 | Hwang et al. |
| 6,078,874 | A | | 6/2000 | Piety et al. |
| 6,121,882 | A | * | 9/2000 | Jaul et al. ..... 340/584 |
| 6,315,719 | B1 | * | 11/2001 | Rode et al. ..... 600/300 |
| 6,366,217 | B1 | * | 4/2002 | Cunningham et al. ... 340/870.31 |
| 6,385,772 | B1 | * | 5/2002 | Courtney ..... 725/105 |
| 6,624,760 | B1 | * | 9/2003 | Kinzel et al. ..... 340/870.11 |
| 6,631,333 | B1 | * | 10/2003 | Lewis et al. ..... 702/24 |

* cited by examiner

*Primary Examiner* — Timothy Edwards, Jr.
*Assistant Examiner* — Hung Q Dang
(74) *Attorney, Agent, or Firm* — Buchanan Ingersoll & Rooney PC

(57) ABSTRACT

Remote monitoring of the munition assets is directed to providing a munitions monitoring system and method for monitoring the environment approximate to a munition and transferring data of the environment to a location remote from the munition for storage or processing. A local monitoring device communicates directly with a remote device at a location remote from the munition, the monitoring device being proximate to a munition with a plurality of sensors that monitor the environment of the munition. The local monitoring device can communicate directly with a centralized relay system that is located in the general proximity to a munitions stock pile and/or with a mobile remote device, such as mounted on a vehicle or a hand-held device. The data can be correlated with the operability of the munition.

34 Claims, 6 Drawing Sheets

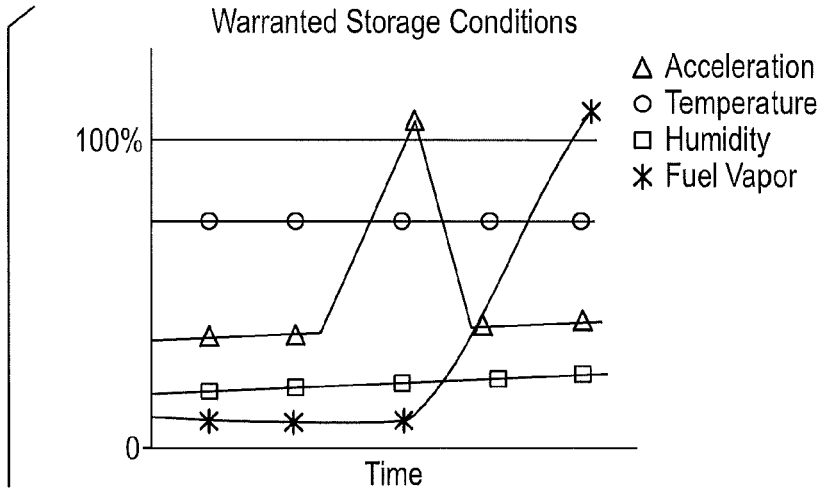
FIG. 7
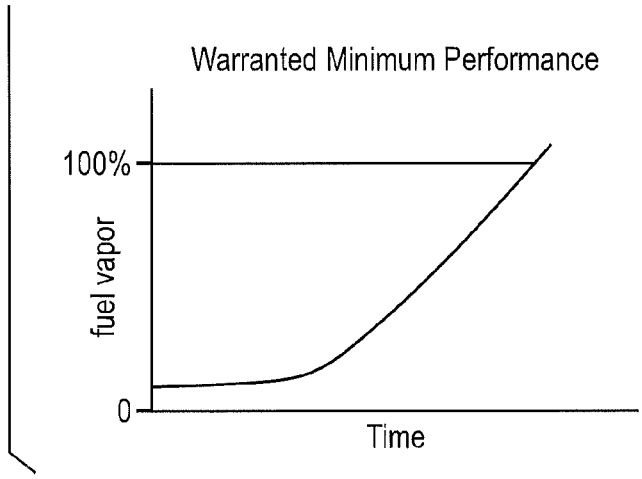

REMOTE MONITORING OF MUNITION ASSETS

BACKGROUND OF THE INVENTION

1. Field of the Invention

The present invention relates to an apparatus and method for monitoring munition assets during storage.

2. Description of the Related Art

Presently, there is no method or system by which the operability of a stored munition can be remotely checked to ensure that the munition will operate as desired when activated after a period of storage. Furthermore, there is no known method or system for determining the time, location, and type of damage which has occurred to a stored munition. Hence, management of a given munition inventory is limited to use of a broad estimate of the total number and condition of properly functioning units.

U.S. Pat. No. 5,036,465 entitled "A Method of Controlling and Monitoring a Store" discloses an architecture that links munitions together to a control process station. The station can interrogate the weapons systems for pre-flight checks and accepts feedback from the system, and further accounts for the electrical condition of the subsystems within the weapon. However, the station does not monitor mechanical or chemical states of the stored weapon or the approximate environment surrounding such weapon. The architecture is also reliant upon the internal fault detection systems built into each weapon, and does not access or record environment conditions that could create fault conditions.

U.S. Pat. No. 5,528,228 entitled "A Protective Device for Transport Containers" discloses a local monitoring system that contains an orientation sensor to ensure that the container is oriented in the correct position during transit. The system locally monitors temperature, and includes an acceleration sensor for detecting impacts. Sensor data is stored in the system which is fixed to the container wall. A local alarm sounds when the container is improperly oriented. The system does not, however, monitor the contents of the container, nor does it compile any record of events.

U.S. Pat. No. 4,876,530 entitled "A Method for Detecting Leaking in Fuel Systems" includes an array of hydrocarbon sensors around a field tank or storage system. The sensors have preset thresholds that set off an alarm when a concentration of leaked fuel is reached. The alarm includes a local visual and audible alarm and dials a phone number as a remote alarm. The system includes a pressure sensor for monitoring fuel pressure and product line. The system does not allow for monitoring in various locations or during transport, nor does the system monitor environmental conditions, analyze data, or record a time sequence of events to provide for complete remote monitoring.

SUMMARY OF THE INVENTION

The present invention is directed to providing a munitions monitoring system and method for monitoring the environment approximate to a munition and transferring data of the environment to a location remote from the munition for storage or processing. For example, the data can be correlated with the operability of the munition. In accordance with one embodiment of the present invention, a local monitoring device communicates directly with a remote device at a location remote from the munition, the monitoring device being proximate to a munition and comprising a plurality of sensors that monitor the environment of the munition. The local monitoring device can communicate directly with a centralized relay system that is located in the general proximity to a munitions stock pile and/or with a mobile remote device, such as mounted on a vehicle or a hand-held device. Communication can be accomplished over a network of RF links, such as a cellular phone network, the Internet, and/or via a satellite and/or infrared data links, or any other desired communication path. A manufacturer's warranty provision of the munition can thus be monitored by collecting data on fault conditions that correspond to the environment in which the munition is exposed.

Generally speaking, exemplary embodiments are directed to a system and method for monitoring a munition comprising: a sensor means, associated with a given munition, for detecting status information regarding the environment proximate to the munition; and, means for wirelessly communicating the status information from the sensor means to a remote device at a location remote from the munition.

Alternative embodiments are directed to a system and method for monitoring a munition comprising: a sensor means, associated with a given munition, for detecting status information regarding the environment proximate to the munition; means for wirelessly communicating the status information from the sensor means to a remote device at a location remote from the munition wherein the means for communicating status information comprises a centralized relay that receives status information from the sensor means by a first subcommunication means and relays status information to the remote device at a location remote from the munition by a second subcommunication means.

A specific embodiment is directed to a system and method of monitoring a munition comprising: a status sensor located in an environment proximate to and associated with a given munition; a transmitter connected to the status sensor; a receiver configured to receive status information from the status sensor; and, a memory connected to the receiver to store status information.

Another embodiment is directed to a method for managing a warranty of a munition comprising the steps of: sensing status information associated with the environment proximate to a given munition; storing the status information; comparing the status information to warranty storage requirements; comparing the status information to warranty performance requirements; and exercising warranty provisions if warranty storage requirements were met and warranty performance requirements were not met.

BRIEF DESCRIPTION OF THE DRAWINGS

FIG. 7 is a representation of status information at the remote device after processing.

DETAILED DESCRIPTION OF THE PREFERRED EMBODIMENTS OF THE INVENTION

Figure 1:
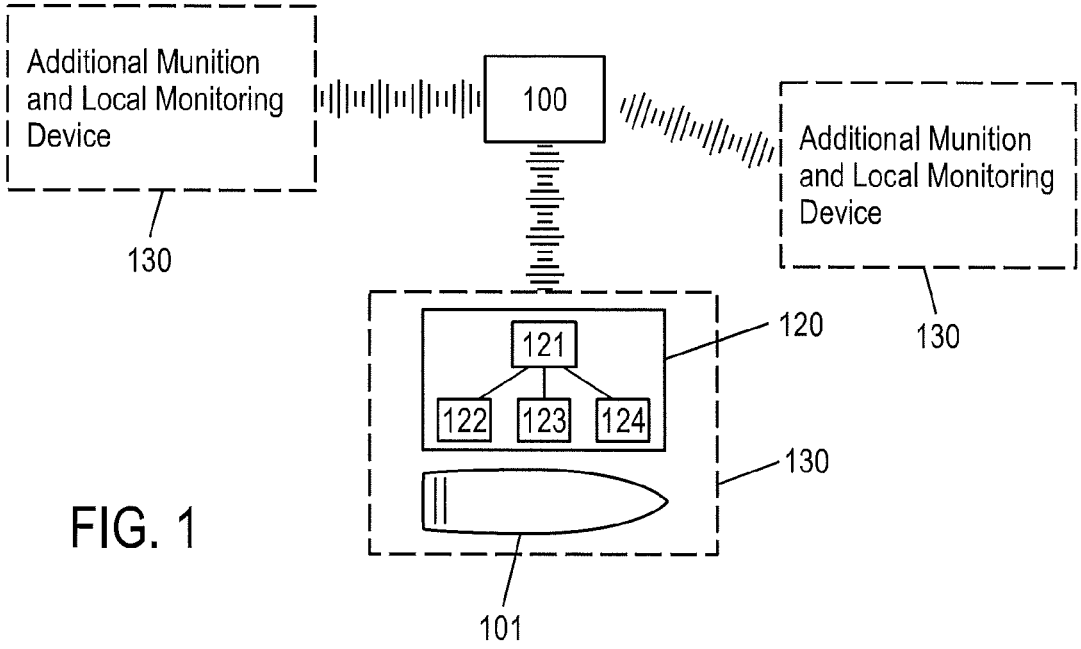
FIG. 1 is an illustration of a munitions monitoring system with direct communication between a local monitoring device and a remote device.

FIG. 1 illustrates an exemplary system for monitoring a munition. The system comprises: a sensor means, associated with a given munition, for detecting status information regarding the environment proximate to the munition. Each munition would typically be an asset such as a missile, rocket, self-guided bomb, torpedo, drum, and so forth. The status information is in the form of quantitative values of the measured environment conditions or qualitative indicia of the same, such as acceptable/not acceptable. The monitoring system includes a sensor means 122, forming a constituent part of a local munition monitoring device 120, for detecting status information regarding the environment 130 proximate to the munition. That is, the sensor means has access to the environment that is affected by and/or that affects the munition.

The environment proximate to the munition can be the medium, typically air, that has relatively the same characteristics, temperature, humidity, particles, as the medium in direct contact with the munition. Such medium would also be capable of freely associating with the munition. The environment within a storage container or deployment tube would generally meet these requirements. The munition monitoring device 120 can be on a storage, transfer or deployment container, in the container, or in the general region of the munition asset so long as the environment proximate to the munition can be monitored.

The sensor means can be comprised of a plurality of sensors indicated in FIG. 1 as 122, 123 and 124. Any number of sensors can be associated with the sensor means.

In FIG. 1, the system also includes a means, represented as a collecting and transmitting device 121, a part of the local munition monitoring device for wirelessly communicating the status information from the sensor means to a location remote from the munition. For example, the collecting and transmitting device 121 collects and transmits data from the sensor means 122, 123, and 124 to a remote device 100. Transmission of the status information can be performed periodically, upon request or upon occurrence of a predetermined event such as occurrence of an environmental fault condition. In developmental testing the transmission of status information was accomplished with an RF card every 5 seconds, although any desired interval, or continuous transmission, could be used.

The transmission can be accomplished over a network of wired and/or wireless communication links, such as a cellular phone network, the Internet, a satellite, and/or any other links, including but not limited to radio frequency (RF) links, and infrared links. In radio frequency communications the electromagnetic frequency spectrum can be used from the very low frequencies VLF through the short waves of a few megahertz to tens of megahertz, the very high frequencies VHF and ultra high frequencies UHF and microwaves. The transmission is sent out on the radio frequency channel by, for example, modulating a radio frequency carrier, amplitude modulation or frequency modulation can be used. Such methods of transmitting signals are well known in the art. Furthermore, the signals can be transmitted in analog form or digital form. In transmitting in digital form, an analog-to-digital converter can be used prior to transmission, when the original signal is detected as an analog value. Similarly, a digital-to-analog converter can be used to convert digitally detected values into analog values for transmission. The collecting and transmitting device 121 can optionally act as a transceiver to receive information from a remote device at a location remote from the munition, for initializing and/or modifying the operation of the sensors, and/or for requesting status information as well as acknowledging receipt of transmission.

The remote device comprises a receiver and a processor. For example, a RF receiver connected to a personal computer can be used. A variety of receivers compatible with the transmitter of the local munition monitoring device can be used. The processor can be a minicomputer, a microcomputer, or a microprocessor. The processor can also be in the form of a mainframe or portable computer. The geographic position between the remote device and the munition at the maximum can, in exemplary embodiments, be within the propagation range of the particular means used to transmit the status information. On the minimum side it can approximately be an order of magnitude of the largest dimension of the munition such that multiple munitions could be monitored from the same location, or can be less than this if desired. The processor is configured to allow a user to identify in real time a variety of electrical, chemical and mechanical conditions pertaining to the munitions asset. It also compiles a time sequence with corresponding environmental events that allows the asset history to be recorded to establish the environmental conditions in which the munition was subjected and to identify any anomalies or fault conditions. For example, a personal computer using a commercial spreadsheet can be used to create a database containing the time sequence and status information. From the time history of the asset, certain components and/or systems that are susceptible to different environmental conditions that are contained in the time history can be individually inspected or maintained to ensure the munitions operability, without engaging in a general inspection of the entire munition.

The sensor means 122, 123, and 124 and possibly others, correspond to components capable of determining the status of the environment in which they are exposed as discussed earlier. The sensors can be arranged within the environment proximate to the munitions such that they access as needed, to those conditions actually experienced by the munition. Fuel sensors are configured to determine the presence of chemicals pertaining to generally propulsion fuel and specifically, levels of JP10 jet fuel. For example, fuel sensors sensitive to fuel vapors as low as 17 to 18 or more parts per million or less can be used. The detection of fuel in the environment proximate to the munition is an indication of a fuel leak. Fuel leaks, in addition to reducing the fuel reserve for use by the munition, also create other conditions that may cause a fault in the operation of the munition. Electronic or other electrical systems exposed to fuel or fuel vapors can cause degradation and corrosion of mounts, insulation and generally interfere with other respective functions of the systems. Inadvertent ignition of fuel vapors during storage or use can further damage the munition or create a scenario in which collateral damage is done to other munitions and/or capital assets. Other sensors such as accelerometers measure acceleration induced on the munition asset as well as temperature and humidity sensors to evaluate ambient environmental conditions proximate to the munition asset.

Acceleration experienced by the munition that exceeds the design limit can cause structure failure in the munition, leading to general malfunctions, fuel leaks and other component failures. Detection of excessive acceleration provides the ability to perform inspection and maintenance of affected systems prior to being deployed. Similarly, extremes in temperature and humidity can have other deleterious effects on the munition and/or munition systems. Such monitoring can be used to direct inspection and maintenance, periodically, upon a trigger or prior to deployment. Other sensors that can be used include surface acoustic wave sensors, chemical resistors and catalytic sensors.

The selection of sensors is predicated upon the vulnerability of the munition to different environmental conditions. Similarly, for munitions in the genre of biological, chemical, or nuclear weapons, such monitoring would provide an indication of environmental conditions that while such contamination would not necessarily correlate with a fault condition affecting the operation of munition would, however, create the possibility of harm to associated personnel. The sensor means can be selected from a variety of known instruments.

Sensors used to determine a temperature in the environment proximate to a munition include thermocouples, thermistors, resistance thermometers, integrated circuit temperature sensors, quartz thermometers. Thermocouples provide a voltage that is generally proportional to the temperature. Thermistors are semiconductor devices in which the resistance changes with temperature, these devices are relatively inexpensive and work well for temperature range of −50° C. to +300° C. Resistance thermometers have their resistance change as a function of temperature and are useable over a temperature range of −200° C. to +1000° C. Integrated circuit temperature sensors provide a voltage output roughly proportional to the temperature. Quartz thermometers are also able to determine the temperature by producing a change of resonance frequency. Other means of detecting temperature ranging from the simple to more complex are also available and could be used as the sensing means.

Sensing means for acceleration can include linear variable differential transformer (LVDT) and strain gauges. The LVDT produces an induced voltage that is proportional to the displacement. The strain gauge measures elongation and flexure by a change in the resistance. Both the LVDT and the strain gauge can be readily transformed into a device that measures acceleration by methods that are well known in the art. Capacitance transducers are also capable of measuring displacement and as such can sense acceleration. Other such sensing means such as piezoelectrics and other more or less complex methods can also be used as the acceleration sensor means.

Biological and chemical sensor means can be accomplished by electrochemical methods such as electrochemistry with ion specific electrodes, electrophoresis, voltametry and polarography as well as techniques like chromatography, infrared visible spectroscopy, masspectroscopy, x-rays, spectroscopy, nuclear quadruple spectroscopy and many other methods depending on the biological or chemical material selected for monitoring. For example, a commercially available Figaro gas sensor and a Cryano Sciences chem-resistor can be used to detect the presence and concentration of JP10 fuel. The detection of fuel vapors can result in the resistance of the Cryano Sciences sensors increasing and the conductivity of the Figaro sensors increasing. For sensing humidity, a commercially available Honeywell or other humidity sensor can be used and is readily known and available.

Figure 2:
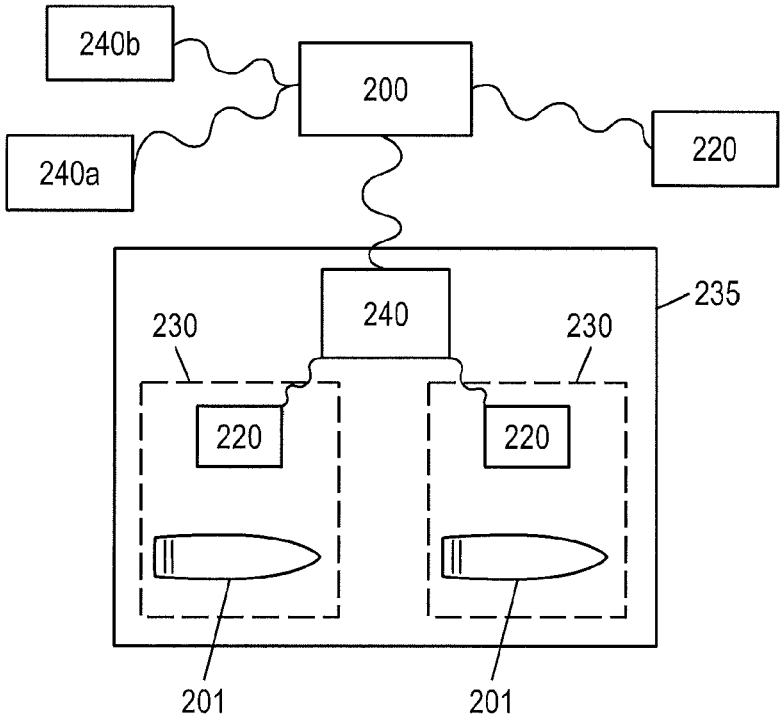
FIG. 2 is an illustration of a munitions monitoring system where the local monitoring device communicates with a centralized relay which in turn communicates with a remote device.

FIG. 2 is an exemplary embodiment of a system for monitoring a munition comprising: a sensor means, associated with a given munition 201, for detecting status information regarding the environment 230 proximate to the munition. Means are provided for wirelessly communicating the status information from the sensor means to a remote device at a location remote from the munition. In the FIG. 2 embodiment, the means for communicating status information comprises a centralized relay 240 that receives status information from the sensor means by a first subcommunication means and relays status information to the remote device 200 by a second subcommunication means. This embodiment incorporates an intermediate centralized relay 240 that receives status information from the local monitoring device 220. The centralized relay 240 comprises a receiver and a transmitter, the receiver being compatible with the transmitter of the local munitions monitoring device and the transmitter being compatible with the receiver of the remote device. The method of transmitting the status information from the local monitoring device to the centralized relay can be of a different method than the method used to transmit the status information from the central relay to the remote device. The selection of the method of communicating the status information can be selected on factors that include propagation, range, energy usage, interference concerns, and/or any other desired factors.

Infrared signals are transmitted generally via line of sight and use pulses or other modulating methods to transmit data. The use of infrared to communicate is well known in the art and its low cost and low power consumption makes it useful in many applications.

The centralized relay 240 is located in a munition stock pile 235 or other geographic delineation. The centralized relay 240, by direct interrogation of the local munition monitoring devices 220, through periodic or event driven reporting, receives the current status information from the sensors corresponding to the environmental conditions proximate to the munition 201. The centralized relay 240 then transmits the data corresponding to numerous munition assets to a remote device 200 that is at a location remote from the munition 201. The centralized relay 240 can optionally store such status information, for periodic, event driven, or upon request reporting to the remote device 200 for processing. This transfer of data can be accomplished through an RF link, by a cellular phone, the Internet, a satellite or any other desired communication path. The remote device 200 receives data from numerous other centralized relays, indicated as reference number 240*a* and 240*b* located in other munitions stock piles, as well as local monitoring devices 220.

Figure 3:
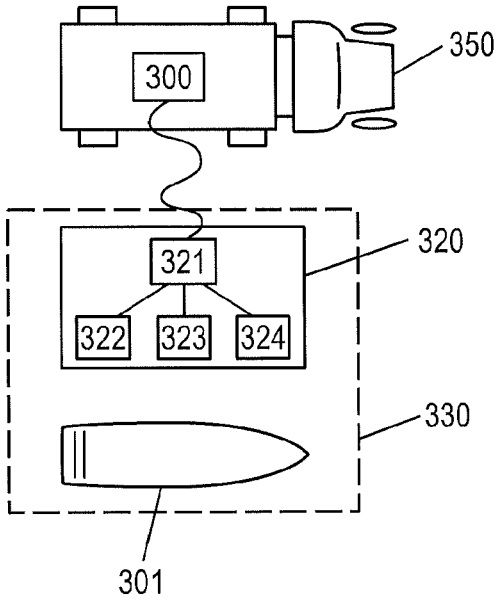
FIG. 3 is a munitions monitoring system where the local monitoring device communicates with a mobile station containing a remote device.

In FIG. 3, a mobile vehicle 350 is equipped with a remote device 300. The vehicle moves through a munition stockpile and as it comes within a predetermined transmitter range of a local monitoring device 320, in this embodiment a close physical proximity to the munition asset, the remote device 300 interrogates the local monitoring device 320. This interrogation triggers the local monitoring device 320 to report the output, via a transmitter 321, of the sensors 322, 323, 324 to the remote device's receiver.

The interrogation of the local monitoring device can be accomplished by wired and/or wireless means. A request, in the form of a signal, from the remote device, either being specific, relating only to that munition, or generally relating to all munitions, can be transmitted to the receiver of a local monitoring device. Upon receiving the request signal the local munition monitoring device can transmit stored status information covering either a fixed period or the period elapsed from the last interrogation. In the case of a specific request, the munition specified would respond with status information. Upon a general request, all local monitoring devices 320 receiving the request can respond.

In the second method, the remote device 300 would determine by signal strength, or other measurement of signal quantity, or by bandwidth, in the event each transmitter of the local monitoring devices has a unique bandwidth, or other desired method, which munition and related signal would be processed and/or stored. Where the munitions 301 are in close proximity to each other compared with the request or response signal range, differentiation of the signals can become more important. Upon receipt of status information from a given munition, a receiver for that munition could receive a specific request to end the transmission of status information to avoid interference with other such signals, the signal could alternately be transmitted by other known means, such as CDMA, FDMA or TDMA, or could be filtered out by the remote location, after the status information is received.

Depending at least in part on the distance between the remote device 300 and the munition 301, a short range radio frequencies or infrared signal can be used as the method of communication. The use of short range radio frequencies and infrared signal can minimize interference with other communications in a congested spectrum as well as provide a degree of security by not broadcasting signals over a wide area some of which could be accessible by hostile forces. Hostile interference with the operation of the monitoring system can also be minimized since a close proximity to the munition is necessary for communication. Such a system becomes advantageous in situations where the munition assets are located over a large geographic area which is typical during in-theater deployment or stockpiling.

Figure 4:
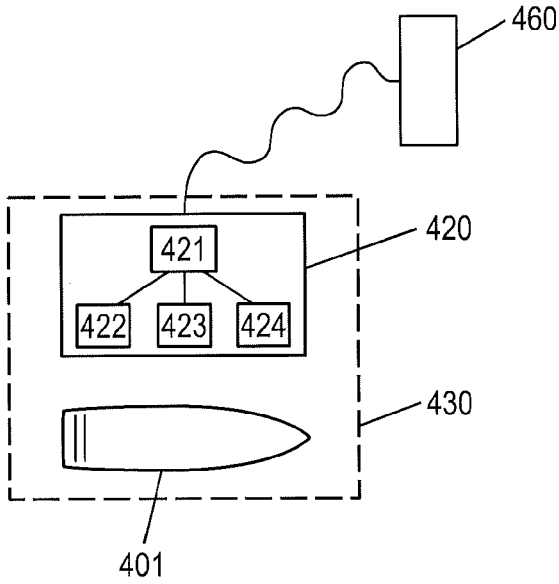
FIG. 4 is a munitions monitoring system where the local monitoring device communicates with a hand-held remote processing device.

In FIG. 4, a remote device 460 is illustrated in the form of a hand held unit. The user moves into the range of the munition monitor device's transmission range and gathers the status information using, for example, RF or IR. This method of interrogating the local monitoring device 420 to report the output of the sensors 422, 423 and 424 reduces the amount of energy used by the transmitter 421 compared with periodic transmissions and can improve the lifetime of the battery and operation of the sensors.

Figure 5:
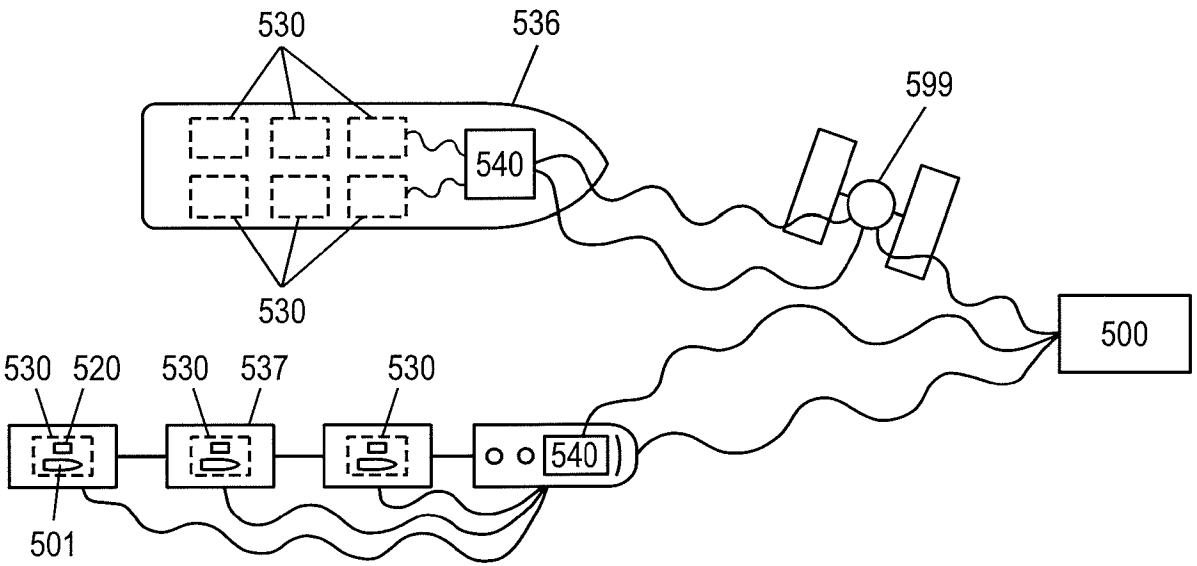
FIG. 5 is a munitions monitoring system with a centralized relay aboard a transportation asset.

An alternative embodiment as seen in FIG. 5 operates similarly to the munition stockpile embodiment described above and in FIG. 2. The centralized relay 540 is located on a transportation asset, such as an aircraft, a transport ship 536, truck, convoy or series of rail cars 537. The centralized relay 540 located on the transportation asset would be responsible for gathering, relaying or storing information from the munition assets aboard the transportation asset during transport. As such, the centralized relay system 540 gathers status information via any of the previously mentioned methods, from those munitions 501 and either periodically upon the occurrence of a predetermined event or upon request, relays such information to the remote device 500 via RF links, satellite 599, mobile telephone or other transmitting means, along with such other information that would be desirable.

For example, the other information can include the identification of the transportation asset, its geographic position, and the identification of each munition being monitored such as an identification code. As such, a remote device 500 at a remote location would be able to determine the type and number of munitions, their current position, and their operational status. This type of information provided during transportation and deployment can be an asset as it relates to force capability and asset management.

The status information contained in the time history report regarding the munitions could also be gathered in a database which can be used in the future to identify problems with the munition and/or storage methods. This information can be used in future developments and future estimates of munition failure rates as well as contributing to the development of life cycle maintenance and cost estimation in future procurements.

In addition to transmitting the sensor information or status information relating to the environment proximate to the munition, the transmitter 520 of the centralized relay system 540 could also transmit upon interrogation or periodic reporting the identification number of the munition being monitored and other data relating to its geographic position and unit assignment, or any desired information.

Figure 6:
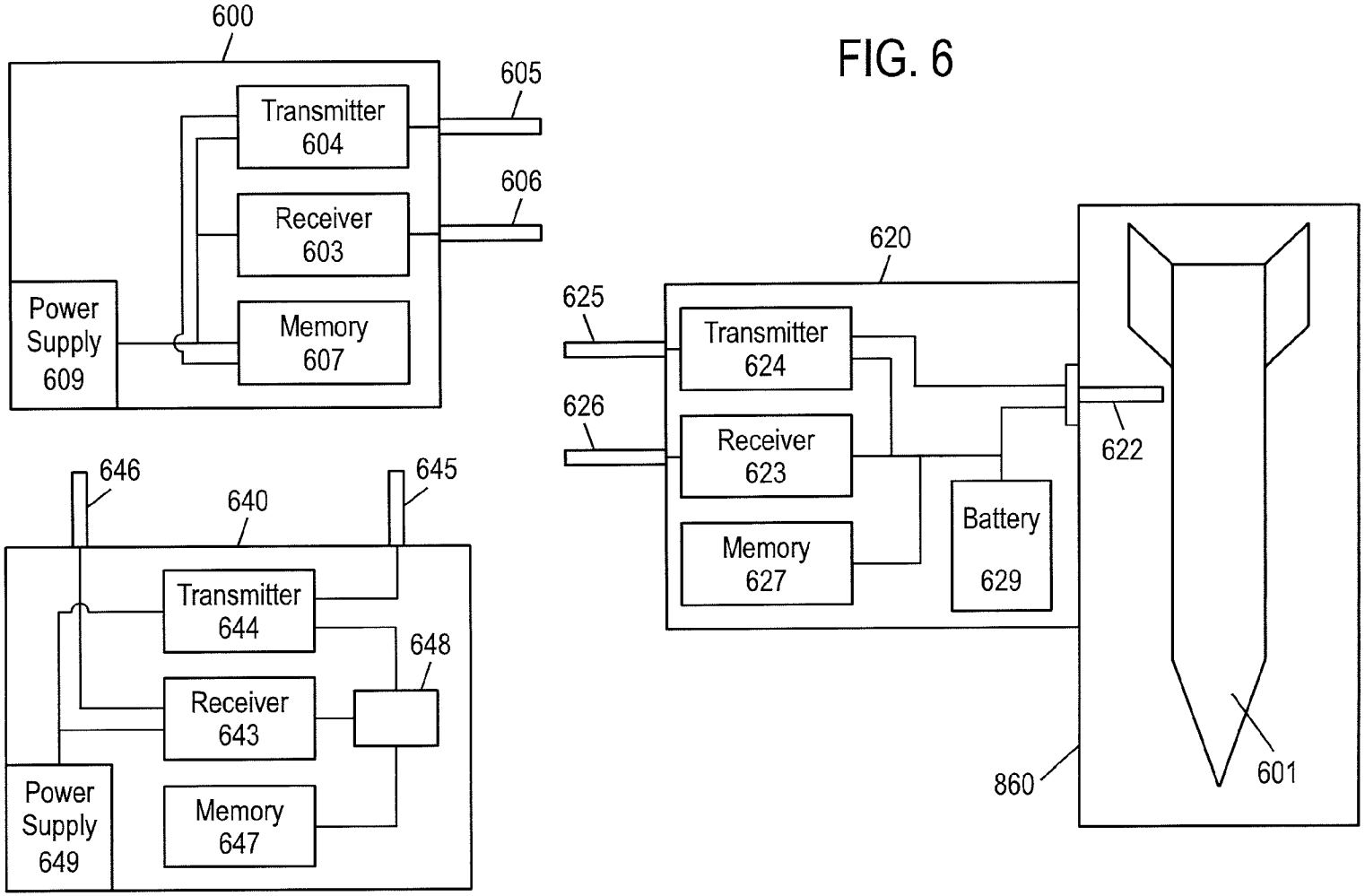
FIG. 6 is a specific embodiment of a munitions monitoring system.

FIG. 6 is a system for monitoring a munition comprising a status sensor located in the environment proximate to and associated with a given munition; a transmitter connected to the status sensor, a receiver configured to receive status information from the status sensor and a memory connected to the receiver to store status information. In the FIG. 6 embodiment, the status sensor 622 is exposed to the environment proximate to a munition 601 and contained within a storage container 660. The sensor is, for example, a commercially available Figaro sensor which demonstrates increasing conductivity with increasing concentration of combustible gas sensor fuel vapor, (e.g., JP10 jet fuel), or any other desired sensor.

The status information is relayed to transmitter 624 that modulates the signal and broadcasts the modulated signal over the antennae 625 every 5 seconds. A battery 629 supplies the transmitter 624 and the status sensor 622 with the required power. The transmitter 624, battery 629, and status sensor 622 and antennae 625 are constituents of the local munition monitoring device 620.

The remote device 600 comprises a receiver 603 associated with an antennae 606 which receives the modulated signal from the local monitoring device's transmitter 624. The receiver demodulates the broadcast signal and stores the status information in a memory 607.

To facilitate two way communication between the remote device 600 and the local monitoring device 620 a receiver 623 and associated antennae 626 can be included in the local monitoring device. The receiver 623 capable of receiving and demodulating signals from a transmitter 604 and associated antennae 605 of the remote device 600. The local monitoring device can also include a memory 627 to facilitate storing status information received from the status sensor 622 such that periodic reporting on a less frequent basis could be achieved. In addition, a controller, not shown, could be incorporated into the local monitoring device 620 to facilitate control of the transmitter, receiver, and memory. Such a controller would also be desirable for facilitating communication during interrogation of the local monitoring device 620. The remote device 600 would also necessarily have a power source 609 that could be a battery or connected to an alternative power source.

The FIG. 6 embodiment also includes a centralized relay 640. The centralized relay 640 includes a transmitter 644 and an associated antennae 645 that is capable of transmitting signals to the remote device's receiver 603. The centralized relay system also contains a receiver 643 and associated antennae 646 that is capable of receiving signals from the local monitoring device's transmitter 624.

The centralized relay 640 also includes a relay 648 in this embodiment, and an amplifier, not shown, that amplifies the signal prior to transmission from the transmitter 644. Such relay 648 can also include a means to transform the signal from one method of transmission to another method of transmission where communication between the centralized relay 640 and the local monitoring device 620 is carried out in a different manner than communications between the centralized relay 640 and the remote device 600. The central relay 640 can optimally store status information received from the local munition monitoring device 620 in a memory 647 such that the central relay system can accumulate status information and then periodically report such information to the remote device 600.

To facilitate reverse communication between the remote device 600 and the local monitoring device 620 the transmitter 644 can optionally communicate with the receiver 623 of the local monitoring device and the receiver 643 of the centralized relay system could be capable of receiving signals from the transmitter 604 of the remote device 600.

Controllers, not shown, can be used in the remote device 600 and the centralized relay 640 to assist in interrogation and other operations of the transmitters and receivers as well as control periodic reporting. The centralized relay 640 also would have a power source 641 capable of providing necessary power. The respective transmitter antennas and receiver antennas in the remote device, the local monitoring device and the central relay may also be incorporated into one antennae or one transceiver.

FIG. 7 contains two graphical representations of exemplary status information obtained by the monitoring devices. The first graphic is that of warranty storage conditions as ultimately relayed to the remote location from the sensors. The second is a representation of the warranted minimum performance of the munition as established in the warranty. Referring to the chart for warranted storage condition, the Y axis represents the upper limit of acceleration, temperature, humidity, fuel vapor resistance, and so forth, as specified in the warranty above which invalidates certain provisions of the warranty. Typically, a manufacturer guarantees the operation of a munition so long as it is maintained, operated, or stored within certain parameters.

In the exemplary chart used to demonstrate the several different types of environment conditions, the Y axis is delineated in percentages with 100% being equal to the maximum allowable condition as specified in the warranty. The monitoring device in practice however will transfer to the centralized system or the remote location raw numbers corresponding to the respective environmental condition. The X axis can be time which, for the purposes of this representation, is not quantified. However, depending on the amount of memory available in both the processing device at the remote location, and the monitoring device, the time base can be from seconds, hours, to days or even months or any desired time base. In relatively stable environments, the time between sensing status information can be relatively large. However, in an environment which is subject to rapid change or environmental conditions that are sporadic, such as acceleration, the time period can be smaller or even result in continuous reporting.

A munition identification code can be associated with each time history of the status information to identify the specific munition which corresponds to the data. Also, as seen in the warranted storage conditions chart are four parameters relating to acceleration, temperature, humidity and fuel vapor, these parameters represent the status information and are used for illustration only. Other combinations of these and others are foreseen for certain munitions. The line representing temperature is shown with data points as circles and for representation on this graph are at the sixty percent mark which indicate the environment proximate to the munition has been exposed to a constant temperature sixty percent of its maximum allowable under its warranty. The acceleration line indicates the data points indicated as triangles show a constant acceleration load with a peak and then returning to a normal acceleration load indicating that during the time monitored it received an increased acceleration load.

In this particular representation, the acceleration exceeded the one hundred percent mark which indicates that the warranty provisions in regard to acceleration may have been exceeded. As such, it would indicate that malfunctions corresponding to excessive acceleration loads depending on the warranty type might not be covered.

The status information with regard to the humidity is represented as data points with squares and the representation shows a constant humidity in the environment proximate to the munition. The humidity being twenty percent of the maximum allowable and thus well within the warranty provisions. The line representative of the presence of fuel vapor is represented at data points with "X" and as seen from the representation after the acceleration spike the exposure to fuel vapor in the warranty has been exceeded. From the chart it is evident that the acceleration experience by the munition may have resulted in the subsequent fuel leak and since the munition was not warranted for such a load, such a leak could be determined to be outside the scope of the warranty.

Referring to the second chart titled "Warranted Minimum Performance", the Y axis is again, for representation purposes only, delineated in percentages with the percentage being the ratio of actual monitored amount of fuel vapor, radiation, biological matter or chemicals detected in the environment proximate to the munition and the warrantors minimum performance values as it relates to the amount of fuel or radiation, leaks, etc. The warrantors' minimum performance are, for example, those parameters that are generated by the manufacturer with regard to storage of munitions. These parameters can include a maximum amount of leakage of fuel or other material from the munition that would be acceptable to ensure the proper function of the munition. This data can also include a munition identification code to identify the munition to which the data is associated.

The representation of fuel vapor in the environment proximate to the munition is represented as a line and as evident exceeds the minimum warranted standards thereby possibly violating the warrantors' guarantee of specific performance. The presence of such a high concentration of fuel vapors above which the minimum standards set by the warrantor taken alone for this representation would suggest that the warranty could be exercised against the warrantor for lack of specified performance. However, with the first set of status information in the first chart a lack of performance caused by the warrantee's failure to maintain the munition in the proper environment can be determined.

If, for instance, the first chart demonstrated that all the environmental conditions were maintained within the warranted range, then such failure of performance would allow the warrantee to exercise the provisions of the warranty against the manufacturer. In the event the munition has several different subsystems, each subsystem as well as the whole, could be warranted for a different range or maximum of environment conditions and as such the conditions may exceed the warranted range for some but not the others. Also included in the first chart is a representation of the percentage of the warranted threshold beyond which failure of the system or subsystem is probable. From the chart the environmental conditions experienced by the munition based on their proximity to this line and the particular system or subsystem can be assessed as to whether it should be inspected, replaced or discarded. In this manner, even though the warranted threshold may have been exceeded, the whole munition may not be lost if components or subsystems susceptible to an associated environmental condition can be inspected for defects or replaced.

Figure 8:
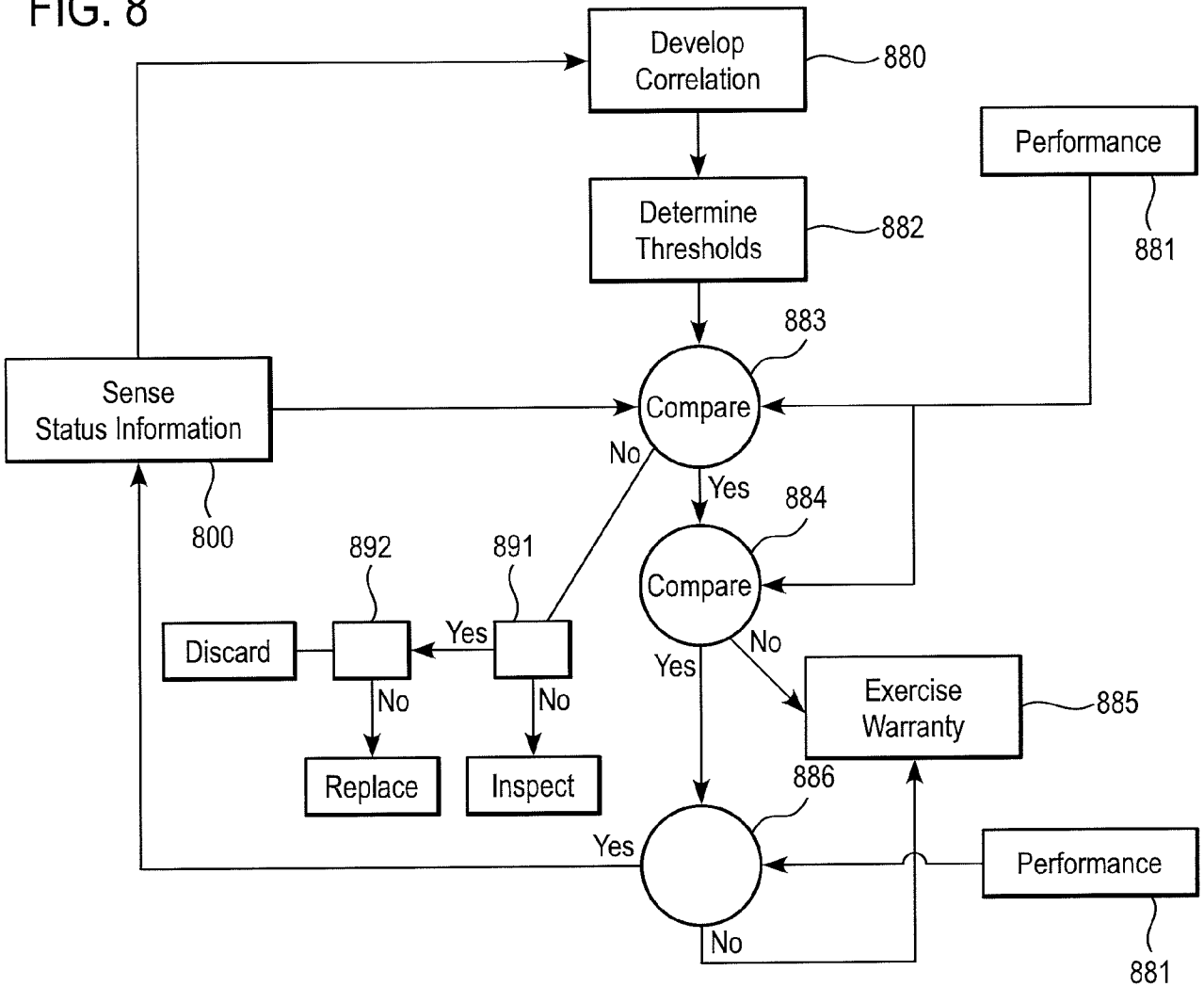
FIG. 8 is a representation of a method for servicing munition warranty.

Exemplary embodiments provide an ability to maintain the functionality of the munitions and the munitions subsystems and an overhaul of the entire munition or loss of the munition is avoided with a minimum cost and a minimum of time. FIG. 8 illustrates the use of the time history and status information of each munition and its affect on the warranty provisions and functionality of the munition.

FIG. 8 is a representation of an exemplary method to maintain the warranty provisions and the functionality of the munitions. In block 880 status information and system or subsystem failures are correlated in order to obtain environmental conditions experienced by the munition beyond which a system or subsystem has been demonstrated to fail. Such data could be acquired through testing or by the theoretical limitations of each system or subsystem.

In block 882, the correlated data is used to determine specific failure thresholds. Such thresholds could correspond to a varying probability of system or subsystem failure. A threshold could correspond to a ninety percent probability of system or subsystem failure, sixty percent possibility of system failure, twenty percent probability of system failure, and so on. Using these probabilities of failure, a sequence of specific thresholds can be established.

For example, a threshold, that is exceeded, indicates an eighty percent probability of system or subsystem failure, and could be deemed as a disregard or replace threshold. A threshold indicating that a parameter exceeding a forty percent probability of failure could indicate an inspection is necessary. Additional specific thresholds, regarding the functionality of the munition, could also be developed and an illustrative example of determining thresholds is presented to aid in understanding.

Where the correlated data in block 880 determines there is an eighty percent probability of fuse failure if the temperature exceeds 200 degrees centigrade, and further demonstrates a twenty percent probability of fuse failure if the temperature exceeds one hundred degrees centigrade. The specific parameter value corresponding to the eighty percent probability of failure could be assigned as the replace threshold and the 100° centigrade corresponding to the twenty percent probability of failure could be assigned as the inspect threshold. Therefore, temperatures approaching 100° centigrade would indicate that the fuse on the particular munition experiencing that environmental condition would need to be inspected, whereas those above one hundred and approaching two hundred might necessarily be replaced.

Block 881 is a step of acquiring the specific performance thresholds from the manufacture of the munition. This data determines beyond which threshold, the manufacturer could be responsible for the maintenance and repair or replacement of the munition or munition sub-system.

Block 800 represents status information obtained through the monitoring of the munition. This information is compared to the specific performance thresholds in block 883 to determine whether the munitions performance is within the specified range provided by the manufacturer.

In block 883 the status information obtained for the munition is compared with the corresponding thresholds developed in 882 including the thresholds beyond which the warrantor may be absolved of responsibility. If the status information of the munition does not exceed the warranty thresholds and thus the warranty conditions remain in tact, the status information is compared with the specific performance thresholds to determine whether the munition is operating within the specified parameters established by the user, and warranted by the manufacturer as represented in block 884.

In the event that the munition fails to meet the specific performance thresholds the user can exercise the warranty against the manufacturer, as indicated in block 885. If, however, in block 884 the status information indicates that the specific performance thresholds have been complied with, then the munition continues to be monitored as represented in block 800. However, if such munition has failed during deployment, the type of failure, if it can be determined, and the status information obtained for that munition is integrated into step 880 to further refine the correlation between the status information and system failures. This step is represented as block 886 and depending on warranty provisions, the warranty could then again be exercised.

Returning to block 883 where the status information is compared with the thresholds determined in block 882, if the status information indicates that the warranty threshold has been exceeded, then in block 891 it is determined whether the inspection threshold has been exceeded. In the event that the inspection threshold has not been exceeded then inspection of the specific system or subsystem is indicated for the munition. From the results of the inspection, the munition is either returned to operational condition or undergoes the appropriate repair. If in block 891 the inspection threshold has been exceeded then the status information is compared in block 892 with that of the replacement threshold if the replacement threshold has not been exceeded, the system or subsystem corresponding to the particular environmental condition would be slated for replacement. Furthermore, such information would be contributed for integration back into block 880, again to further refine the correlation process. If in this example, the replacement threshold was exceeded then the munition would be discarded.

It will be appreciated by those of ordinary skill in the art that the present invention can be embodied in other specific forms without departing from the spirit of or essential characteristic thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. A system for monitoring a munition comprising:

a sensor means, associated with a given munition, for detecting status information regarding the environment proximate to the munition that corresponds to at least mechanical and ambient medium attributes of said environment, each said attribute being detected in temporal intervals;

means for wirelessly communicating the detected temporal status information for each attribute from the sensor means to a remote device at a location remote from the munition, wherein the sensor means comprises at least a chemical sensor; and means for (i) assessing operability of the munition by comparing the detected status information with a first range of at least one of mechanical and environmental conditions regarding operability of the munition, and (ii) assessing whether the detected attributes comply with predetermined warranty provisions including a probability of munition performance warranted by a manufacturer of the munition based on a second range of at least one of mechanical and environmental conditions defined in the manufacturer's warranty in which the manufacturer warrants operability of the munition provided that the munition is at least one of maintained, stored and operated in accordance with the second range of conditions, wherein the second range of conditions warranted by the manufacturer are a subset of the first range of conditions regarding operability of the munition such that the second range of conditions is narrower than the first range of conditions by having at least one endpoint different than a corresponding endpoint of the first range of conditions.

2. A system for monitoring a munition according to claim 1, wherein the means for wirelessly communicating status information is, at least in part, a network of radio frequency links.

3. A system for monitoring a munition according to claim 1, wherein the means for wirelessly communicating status information is, at least in part, a cellular phone network.

4. A system for monitoring a munition according to claim 1, wherein the means for wirelessly communicating status information is, at least in part, an infrared data link.

5. A system for monitoring a munition according to claim 1, wherein the means for wirelessly communicating status information comprises:

a centralized relay that receives status information from the sensor means by a first subcommunication means and relays status information to the remote device by a second subcommunication means.

6. A system for monitoring a munition according to claim 5, wherein the first and second subcommunication means comprise:

a radio frequency link, a cellular phone link, an infrared link and/or a combination thereof.

7. A system for monitoring a munition according to claim 1, wherein the remote device is located on a vehicle.

8. A system for monitoring a munition according to claim 1, wherein the sensor means is adapted to be attached to a storage container.

9. A system for monitoring a munition according to claim 1, wherein the sensor means is adapted to be attached to the munition.

10. A system for monitoring a munition according to claim 1, wherein the sensor means comprises at least one of an accelerometer, a temperature sensor, and a humidity sensor.

11. A system for monitoring a munition according to claim 1, wherein the remote device comprises a hand-held device.

12. The system of claim 1, wherein the compliance of detected attributes with predetermined warranty provisions includes warranting plural different munition subsystems for a different range or maximum of environment conditions.

13. The system of claim 12, wherein the environment condition for one of the warranted plural munition subsystem exceeds its predetermined warranty provision and other subsystems of the munition remain within their predetermined warranty provisions.

14. A method for monitoring a munition comprising the steps of:

sensing status information regarding an environment proximate to a given munition with a local monitoring device;

transmitting the status information to a remote device at a location remote from the munition;

storing the status information at the remote device; and, comparing the status information with a set of predetermined conditions; and assessing operability of the munition by comparing the status information with a first range of at least one of mechanical and environmental conditions regarding operability of the munition, and assessing whether the status information complies with predetermined warranty provisions including a probability of munition performance warranted by a manufacturer of the munition based on a second range of at least one of mechanical and environmental conditions defined in the manufacturer's warranty in which the manufacturer warrants operability of the munition provided that the munition is at least one of maintained, stored and operated in accordance with the second range of conditions, wherein the second range of conditions warranted by the manufacturer are a subset of the first range of conditions regarding operability of the munition such that the second range of conditions is narrower than the first range of conditions by having at least one endpoint different than a corresponding endpoint of the first range of conditions.

15. A method for monitoring a munition according to claim 14, wherein the transmitting step is accomplished by wireless means.

16. A method for monitoring a munition according to claim 14, wherein the step of transmitting the status information includes the steps of:

storing the status information at the local monitoring device prior to transmitting;

sending a request signal from the remote device, to a receiver associated with the local monitoring device;

replying to the request signal by transmitting stored status information from the local monitoring device to the remote device; and, clearing the memory of the storage.

17. A method for monitoring a munition according to claim 14, wherein the step of transmitting the status information includes the steps of:

storing the status information at the local monitoring device prior to transmitting;

transmitting from the local monitoring device, at predetermined periods, stored status information to the remote device; and, clearing a memory of the storage.

18. A method for monitoring a munition according to claim 14, wherein the step of transmitting the status information includes the steps of:

comparing, at the local monitoring device, the status information to a set of predetermined conditions;

determining if the fault conditions have been exceeded; and, if exceeded, transmitting the status information to the remote device.

19. A method for monitoring a munition according to claim 14, wherein the step of transmitting the status information includes the steps of:

storing the status information at the local monitoring device, prior to transmitting;

sending a request signal from a centralized relay, to a receiver connected to status sensors;

replying to the request signal by transmitting stored status information from the local monitoring device to the centralized relay;

clearing a memory of the storage;

storing in the centralized relay, status information associated with at least one given munition; and, transmitting from the centralized relay to the remote device, status information stored in the centralized relay.

20. A method for monitoring ammunition according to claim 19, wherein the step of transmitting from the centralized relay to a remote device, is conducted periodically, upon request of the remote location, or upon the occurrence of a fault condition.

21. A method for monitoring a munition according to claim 14, wherein the step of transmitting the status information includes the steps of:

storing the status information at the local monitoring device, prior to transmitting;

transmitting, at predetermined periods, stored status information to a centralized relay;

clearing a memory of the storage;

storing at the centralized relay, status information associated with at least one given munition; and, transmitting from the centralized relay to a remote device, status information stored at the centralized relay.

22. A method for monitoring a munition according to claim 21, wherein the step of transmitting from the centralized relay to a remote device, is conducted periodically, upon request of the remote location, or upon the occurrence of a fault condition.

23. A method for monitoring a munition according to claim 14, wherein the step of transmitting the status information includes the steps of:

comparing, at the local monitoring device, the status information to a set of predetermined fault condition;

determining if the fault conditions have been exceeded; and if exceeded, transmitting the status information to the centralized relay;

storing at the centralized relay system, status information associated with at least one given munition; and, transmitting from the centralized relay system to a remote device, status information stored at the centralized relay system.

24. A method for monitoring ammunition according to claim 23 wherein the step of transmitting from the centralized relay to a remote device, is conducted periodically, upon request of the remote location, or upon the occurrence of a fault condition.

25. A method for monitoring a munition according to claim 14, wherein the remote device comprises a hand-held device.

26. The method of claim 14, comprises warranting plural different munition subsystems for a different range or maximum of environment conditions.

27. The method of claim 26, wherein the assessing step comprises: assessing whether the warranted environment condition for one of the warranted plural munition subsystem exceeds its predetermined warranty provision and other subsystems of the munition remain within their predetermined warranty provisions.

28. A system for monitoring a munition comprising:

a status sensor located in an environment proximate to and associated with a given munition, said sensor for detecting attributes of the environment selected from at least two of a chemical sensor, an acceleration sensor and a temperature sensor, wherein the detected attributes are used to assess operability of the given munition based on a comparison of the detected attributes with a first range of at least one mechanical and environmental conditions regarding operability of the munition, and to assess compliance of the detected attributes with predetermined warranty provisions including a probability of munition performance warranted by a manufacturer of the munition based on a second range of at least one of mechanical and environmental conditions defined in the manufacturer's warranty in which the manufacturer warrants operability of the munition provided that the munition is at least one of maintained, stored and operated in accordance with the second range of conditions, wherein the second range of conditions warranted by the manufacturer are a subset of the first range of conditions regarding operability of the munition such that the second range of conditions is narrower than the first range of conditions by having at least one endpoint different than a corresponding endpoint of the first range of conditions;

a transmitter connected to the status sensor;

a receiver configured to receive detected status information from the status sensor; and, a memory connected to the receiver to store detected status information; and another receiver connected to the status sensor and another transmitter connected to the receiver, wherein, the another transmitter communicates with the another receiver.

29. A system for monitoring a munition according to claim 28, wherein the status sensor comprises a chemical sensor, an acceleration sensor and a temperature sensor.

30. A system for monitoring a munition according to claim 28, further comprising, a centralized relay, comprising a relay transmitter and a relay receiver, wherein the relay transmitter communicates with the receiver and the relay receiver communicates with the transmitter.

31. A system for monitoring a munition according to claim 28, further comprising a centralized relay, wherein the transmitters communicate with their respective receivers through the centralized relay.

32. A system for monitoring a munition according to claim 28, wherein said receiver is a component of a hand-held device.

33. A system for monitoring a munition comprising:

a status sensor located in an environment proximate to and associated with a given munition, said sensor for detecting attributes of the environment selected from at least two of a chemical sensor, an acceleration sensor and a temperature sensor;

a transmitter connected to the status sensor;

a receiver configured to receive detected status information from the status sensor; and, a memory connected to the receiver to store detected status information, wherein the status sensor comprises a chemical sensor, an acceleration sensor and a temperature sensor, wherein the detected attributes are used to assess operability of the given munition based on a comparison of the detected attributes with a first range of at least one of mechanical and environmental conditions regarding operability of the munition, and to assess compliance of the detected attributes with predetermined warranty provisions including a probability of munition performance warranted by a manufacturer of the warranty based on a second range of at least one of mechanical and environmental conditions defined in the manufacturer's warranty in which the manufacturer warrants operability of the munition provided that the munition is at least one of maintained, stored and operated in accordance with the second range of conditions, wherein the second range of conditions warranted by the manufacturer are a subset of the first range of conditions regarding operability of the munition such that the second range of conditions is narrower than the first range of conditions by having at least one endpoint different than a corresponding endpoint of the first range of conditions.

34. The system of claim 33, wherein the compliance of detected attributes with predetermined warranty provisions includes warranting plural different munition subsystems for a different range or maximum of environment conditions.

* * * * *